US009345928B2

(12) United States Patent
Philip

(10) Patent No.: US 9,345,928 B2
(45) Date of Patent: May 24, 2016

(54) DEVICE FOR STRENGTHENING PELVIC FLOOR MUSCULATURE IN WOMEN

(71) Applicant: Peter A Philip, New Canaan, CT (US)

(72) Inventor: Peter A Philip, New Canaan, CT (US)

( * ) Notice: Subject to any disclaimer, the term of this patent is extended or adjusted under 35 U.S.C. 154(b) by 17 days.

(21) Appl. No.: 14/595,397

(22) Filed: Jan. 13, 2015

(65) Prior Publication Data

US 2015/0126341 A1 May 7, 2015

Related U.S. Application Data

(63) Continuation-in-part of application No. 14/052,322, filed on Oct. 11, 2013, now Pat. No. 9,084,915.

(51) Int. Cl.

| | |
|---|---|
| ***A63B 21/02*** | (2006.01) |
| ***A63B 21/05*** | (2006.01) |
| ***A63B 71/00*** | (2006.01) |
| ***A63B 23/20*** | (2006.01) |
| ***A63B 21/045*** | (2006.01) |
| ***A63B 21/00*** | (2006.01) |
| ***A63B 21/04*** | (2006.01) |

(52) U.S. Cl.

CPC ..... *A63B 23/20* (2013.01); *A63B 21/0004* (2013.01); *A63B 21/023* (2013.01); *A63B 21/045* (2013.01); *A63B 21/0421* (2013.01); *A63B 21/05* (2013.01); *A63B 21/00061* (2013.01); *A63B 21/00069* (2013.01)

(58) Field of Classification Search

CPC ..... A63B 21/00185; A63B 21/023; A63B 21/025; A63B 21/026; A63B 21/0421; A63B 21/05; A63B 21/4001; A63B 21/4025; A63B 21/4039; A63B 21/4047; A63B 23/032; A63B 23/20

See application file for complete search history.

(56) References Cited

U.S. PATENT DOCUMENTS

| | | | | |
|---|---|---|---|---|
| 1,928,893 | A * | 10/1933 | Hoard | A63B 23/20 601/45 |
| 5,865,715 | A * | 2/1999 | Wallick | A63B 23/20 482/121 |
| 6,224,525 | B1 * | 5/2001 | Stein | A63B 21/026 482/121 |
| 6,258,015 | B1 * | 7/2001 | Blackford | A63B 23/20 482/121 |
| 6,663,545 | B2 * | 12/2003 | Wilson | A63B 21/00043 482/11 |
| 6,733,425 | B2 * | 5/2004 | Blackford | A63B 21/026 482/112 |
| 8,118,726 | B1 * | 2/2012 | Blackford | A61F 2/0009 128/845 |
| 2002/0147082 | A1 * | 10/2002 | Harding-Randle | A63B 23/20 482/128 |

* cited by examiner

*Primary Examiner* — Oren Ginsberg
(74) *Attorney, Agent, or Firm* — Carla Gannon Law

(57) ABSTRACT

A hinged vaginal strengthening device has three points of resistance along its length, which correspond with the three layers of pelvic musculature. The device is inserted into a vagina and compressed by the pelvic floor musculature, in accordance with various regimens to achieve goals such as decreasing vaginal gap or overcoming painful intercourse. The device can be of various dimensions, and various compression resiliencies thereby allowing a user to progress through multiple steps to achieve their goal of increasing or decreasing their vaginal space, as well as increasing muscle tone.

17 Claims, 23 Drawing Sheets

FIG. 8 – PRIOR ART

DEVICE FOR STRENGTHENING PELVIC FLOOR MUSCULATURE IN WOMEN

CROSS-REFERENCE TO RELATED APPLICATIONS

This application is a continuation-in-part of U.S. patent application Ser. No. 14/052,322, filed Oct. 11, 2013, and titled "DEVICE FOR STRENGTHENING PELVIC FLOOR MUSCULATURE IN WOMEN" which claims the benefit of U.S. Provisional Application 61/712,291, which was filed Oct. 11, 2012.

BACKGROUND OF THE INVENTION

The present invention relates to exercise equipment, and more specifically, to a device and method for strengthening, and enhancing the functionality, of the pelvic floor musculature in women.

Weakness and dysfunction of the pelvic floor musculature in women is a common occurrence, and can be attributed to a variety of reasons including pregnancy and birth, the natural ageing process, disease, and disuse. Weaknesses and dysfunction can be a source of medical and personal issues that may affect a woman's quality of life due to back pain, bowel and bladder dysfunction, pain with intimacy, and/or weak to nonexistent orgasms.

Kegel Exercises have been used for decades as a means of strengthening these muscles. However, these exercises are often performed in a fashion that does not accurately recruit the desired musculature. Often the musculature is globally contracting, allowing the stronger musculature to override the weaker musculature, thus perpetuating asymmetry and progressive dysfunctions. Common errors include, but are not limited to the utilization of the respiratory diaphragm, gluteals, groin, and/or abdomen in lieu of the pelvic floor musculature. Many women have a difficult time isolating these muscles, thus making strengthening and/or coordinating them difficult or impossible. Even when a woman can isolate the pelvic floor musculature, she often has a difficult time utilizing them in a weight bearing, or functional fashion, which is why it is common for women to complain of persistent back pain with activity, and loss of urine during activities and coughing/laughing.

Other devices focus on a vertical closure, also known as flat closure, of the pelvic floor musculature. Because the vaginal canal and rectum are cylindrical, or ovoid, that require a narrowing of their lumen to provide their stability, flat closure doesn't allow for optimal stabilization and closure. In fact, flat closure limits the stability by nearly 66%. Thus, devices that facilitate vertical closure are not optimal.

Other devices facilitate evacuation, or pushing outwards, of the vagina. They are often angled in such a fashion that promotes an outward pushing movement in lieu of upward and inward contractions that will stabilize the pelvis, spine and urogenital structures, including the bladder, the uterus and the rectum. Furthermore, these devices put pressure on the bladder and urethra, leading to irritation and pain.

As can be seen, there is a need for a device that addresses the natural, and dynamic nature of the pelvic floor musculature, promoting both the horizontal and vertical vaginal closure alike without causing bladder and/or urethral irritation. It is desirable that this device is customizable, and that the resistance points and overall dimensions of this device are adjustable, allowing for the customization based on a user's unique needs, characteristics and anatomy. It is desirable that this device allows for the strengthening of the three distinct musculature layers of the pelvic floor, without allowing for the "stronger" muscles to "overpower" and inhibit activation of the weakened muscle segments. It is desirable that this invention is appropriate for both medical and general consumption, including post-surgical, non-surgical, continent, incontinent, pain-suffering, pain free, fit and de-conditioned users alike.

SUMMARY OF THE INVENTION

A device and method of strengthening pelvic floor musculature in women includes an elongated device having two semi-round primary arms that are longitudinally aligned with resilient members between. The semi-round primary arms are connected at a hinged joint to a set of secondary arms having two semi-round sections. The primary and secondary arms are similarly shaped with similar diameters, except the secondary arms are preferably shorter than the primary arms. The device preferably includes a handle which is connected by hinges to the secondary arms.

In use, the device is inserted into a vagina, and force is exerted on the arms, thereby compressing the resilient members and bringing the arms closer together (adduction) along their longitudinal axes. Repeated use of this device, by contracting and relaxing the associated musculature, increases pelvic floor health.

The diameter of the device is selected according to the therapeutic goal. In one embodiment each device has one diameter, and multiple devices, of either increasing or decreasing diameter, are used sequentially in a therapeutic regimen. In another embodiment arms having different diameters are interchanged in order to achieve different diameters. In yet another embodiment, sleeves having different diameters are used over the arms, thereby changing the overall girth of the device. Yet another embodiment includes a handle.

The resilient members of the device are also adjustable, or interchangeable. Most desirably, resilient members are within housings, collectively forming a cartridge, and the cartridges are easily inserted and removed from interior of primary arm.

DETAILED DESCRIPTION OF THE INVENTION

The following detailed description discusses the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers apply among the various FIGS.:

10—Strengthening device;
12—Primary arm;
14—Secondary Arm;
16—Hinge;
17—Handle;
18—Sleeve;
20—Resistance axis;
21—Resilient member;
  21*a*—Male portion;
  21*b*—Female portion;
22—Guide rod;
23—Attachment means;
  23*a*—Male attachment means;
  23*b*—Female attachment means;
24—Housing;
25—Cartridge;
26—Interface;
27—Member aperture;
28—Protrusion; and
29—Cut-out tab.

Figure 1:
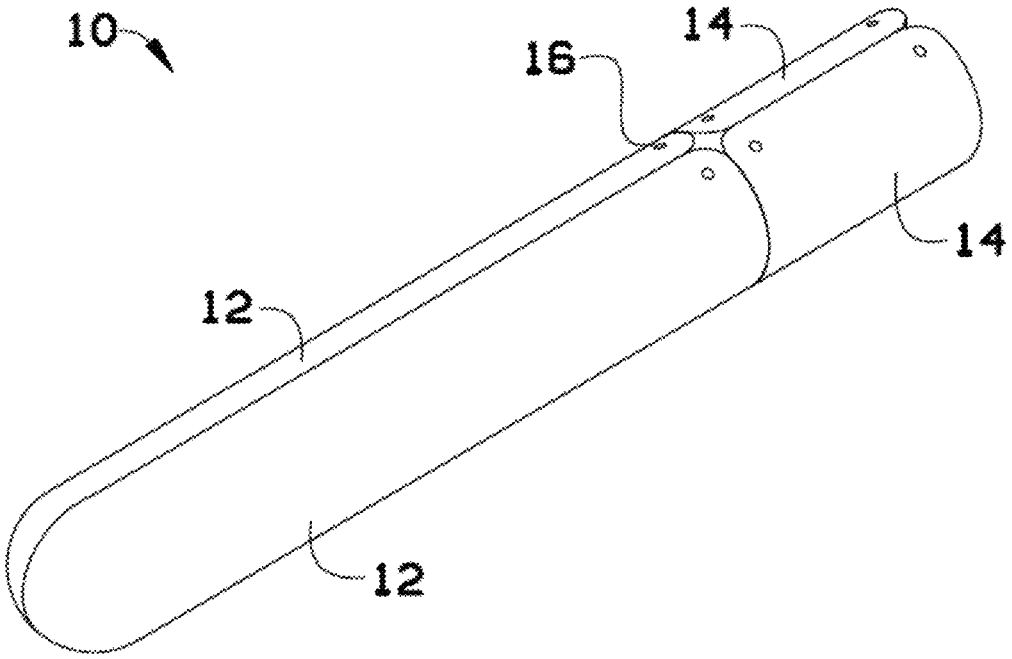
FIG. 1 is a perspective view of an embodiment of the invention.
Figure 2:
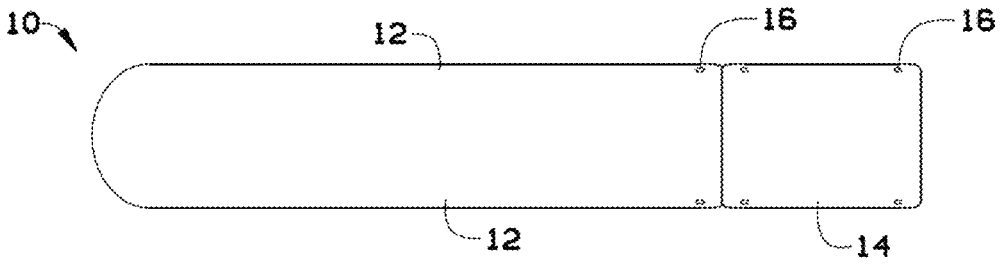
FIG. 2 is a side view of an embodiment.
Figure 3:
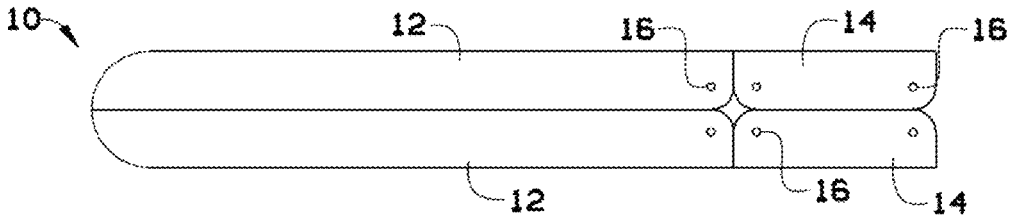
FIG. 3 is a top view of an embodiment.

Referring to FIGS. 1 and 2, strengthening device 10 in the compressed (adducted) position is generally elongated with a cylindrical or ovoid cross-section having a rounded head, two semi-cylindrical or semi-ovoidal (collectively "semi-round") primary arms 12, and two semi-cylindrical or semi-ovoidal secondary arms 14, separated by hinges 16. Device 10 can be used in accordance with methods set forth herein, or it may be used in another manner in order to maintain or develop pelvic health.

Figure 11:
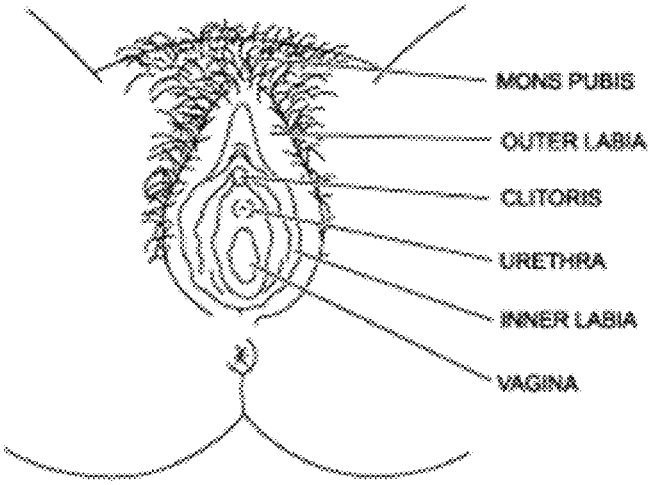
FIG. 11 is a view of a vaginal orifice.

As shown in FIG. 11, the vagina is ovoid in shape. Similarly, the present invention is preferably ovoid. It is desirable that the diameter (average between longest and shortest diameters of oval) of compressed arm 12 is a variety of different diameters, corresponding with different "levels", preferably levels 1-4. It is desirable that the lowest level, level 1, has a diameter of approximately 2 centimeters, the highest level, level 4, has a diameter of approximately 5.5 centimeters, and the mid-levels have diameters there between. The various levels (diameters) accommodate the ranges in sizes and shapes of vaginal orifices due to genetics, trauma, birthing or other factors.

The variability of the diameter can be accomplished in a variety of ways, all of which are within the scope of this invention. In one embodiment arms are sized differently. In other words one device 10 is scaled for level 1, having primary arms 12 and secondary arms 14 of a first specific diameter. Another device having primary arms 12 and secondary arms 14 of a second specific diameter is scaled for level 2, and so forth. In practicing methods of this invention the user would employ multiple devices, probably levels 1-4, one device at a time, as they progress through a given program.

In another embodiment, primary arms 12 are detachable from secondary arms 14, and different sized primary arms 12 are used in accordance with the desired level. In other words a user would employ one set of secondary arms 12, and interchange multiple sets of primary arms 12, probably levels 1-4, one set of arms at a time, as they progress through a given program. This may be used with or without handle 17.

Figure 6:
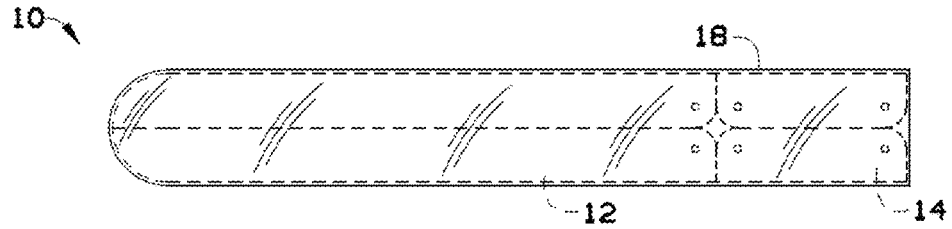
FIG. 6 is a side view of an embodiment including optional sleeve.

In yet another embodiment, sleeves 18 of various thicknesses are used to add girth to arm 12. In other words, one device 10 is used, and different level sleeves 18 are interchanged, one sleeve at a time, as a user progresses through a given program. One sleeve size is depicted in FIG. 6.

Even if sleeve 18 isn't employed to add girth to arms 12, a thin version of sleeve 18 may provide additional comfort for some users, and/or be desired for hygienic reasons. Sleeves, whether for girth or comfort/hygiene, may be constructed of silicone or other material that optimizes patient comfort.

Figure 12:
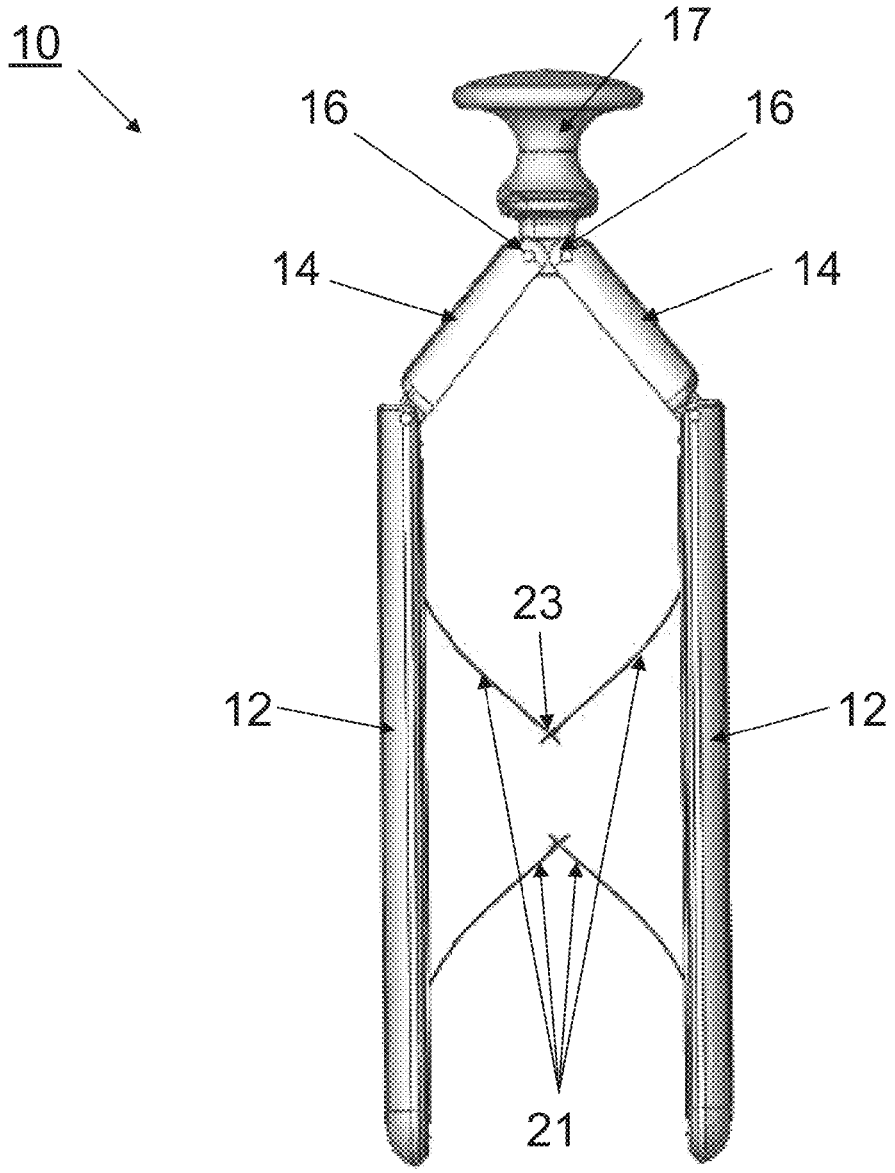
FIG. 12 is a top view of a second embodiment in an expanded position.
Figure 13:
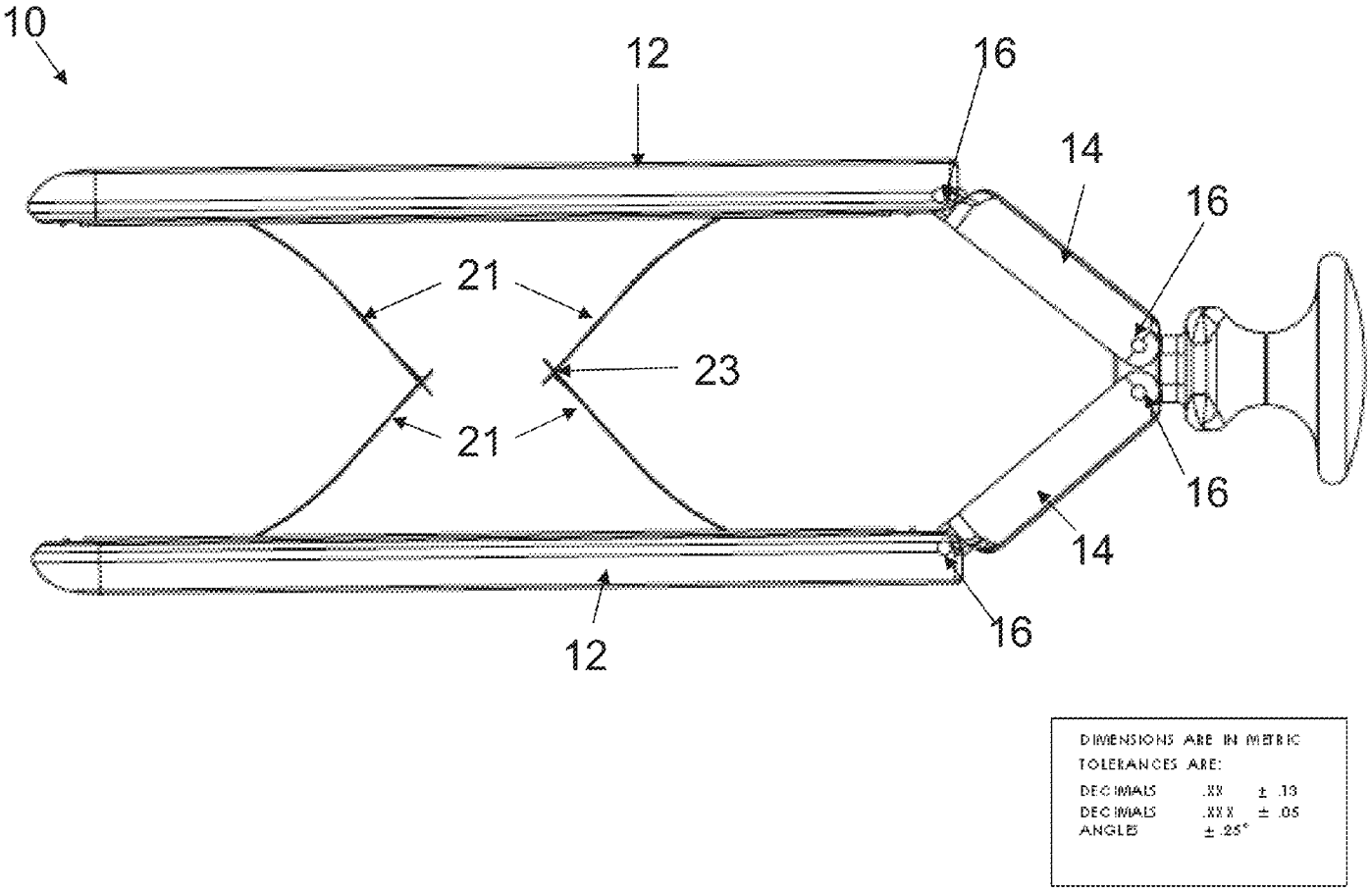
FIG. 13 is a top view of a second embodiment in an expanded position.
Figure 14:
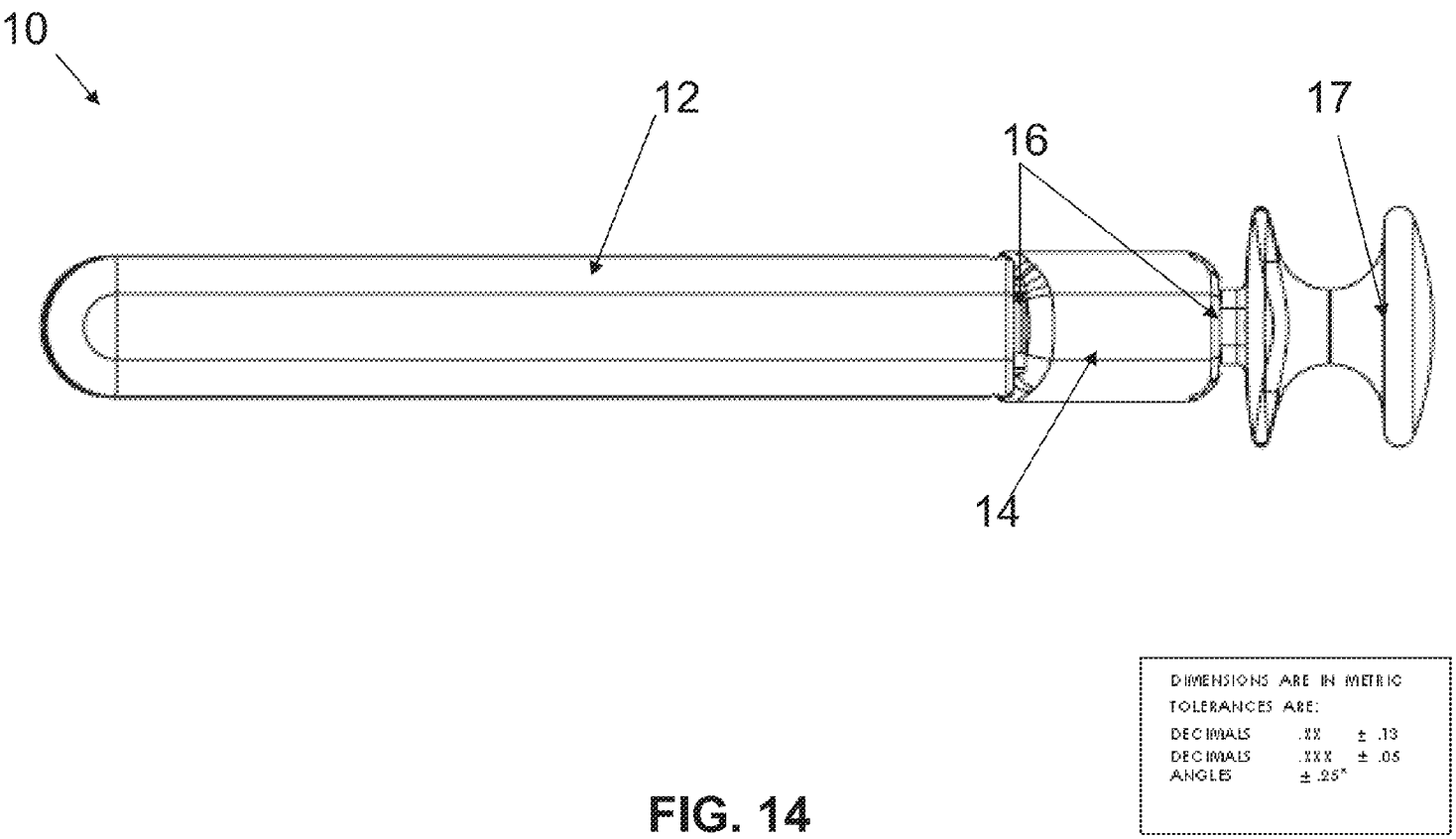
FIG. 14 is a side view of a second embodiment in a non-expanded position.

An alternative embodiment of FIG. 12 includes handle 17 for insertion and removal of device, resilient members 21 that preferably bend inward one to another, and no guide rods.

Figure 15:
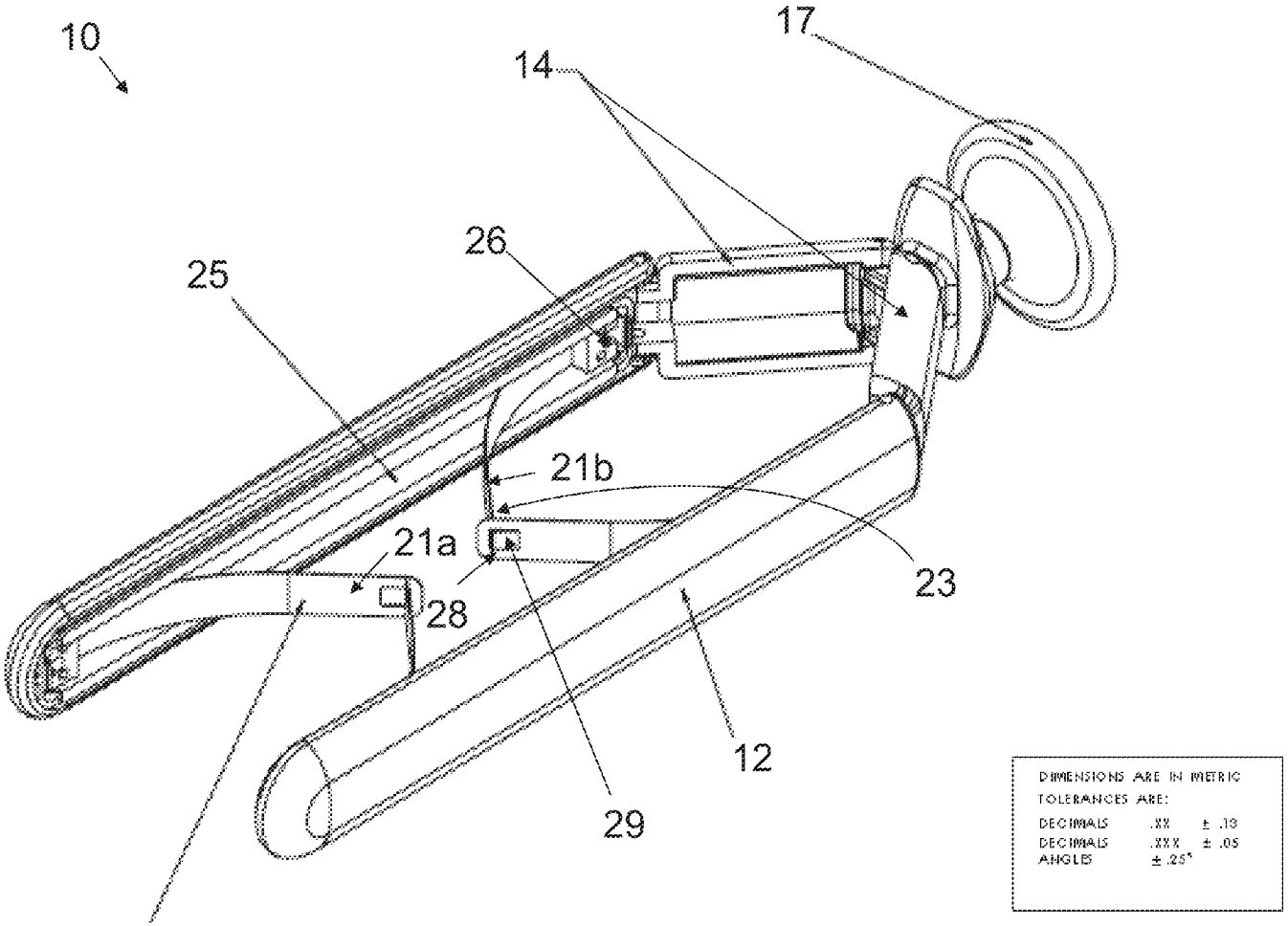
FIG. 15 is perspective view of a second embodiment in an expanded position.
Figure 16:
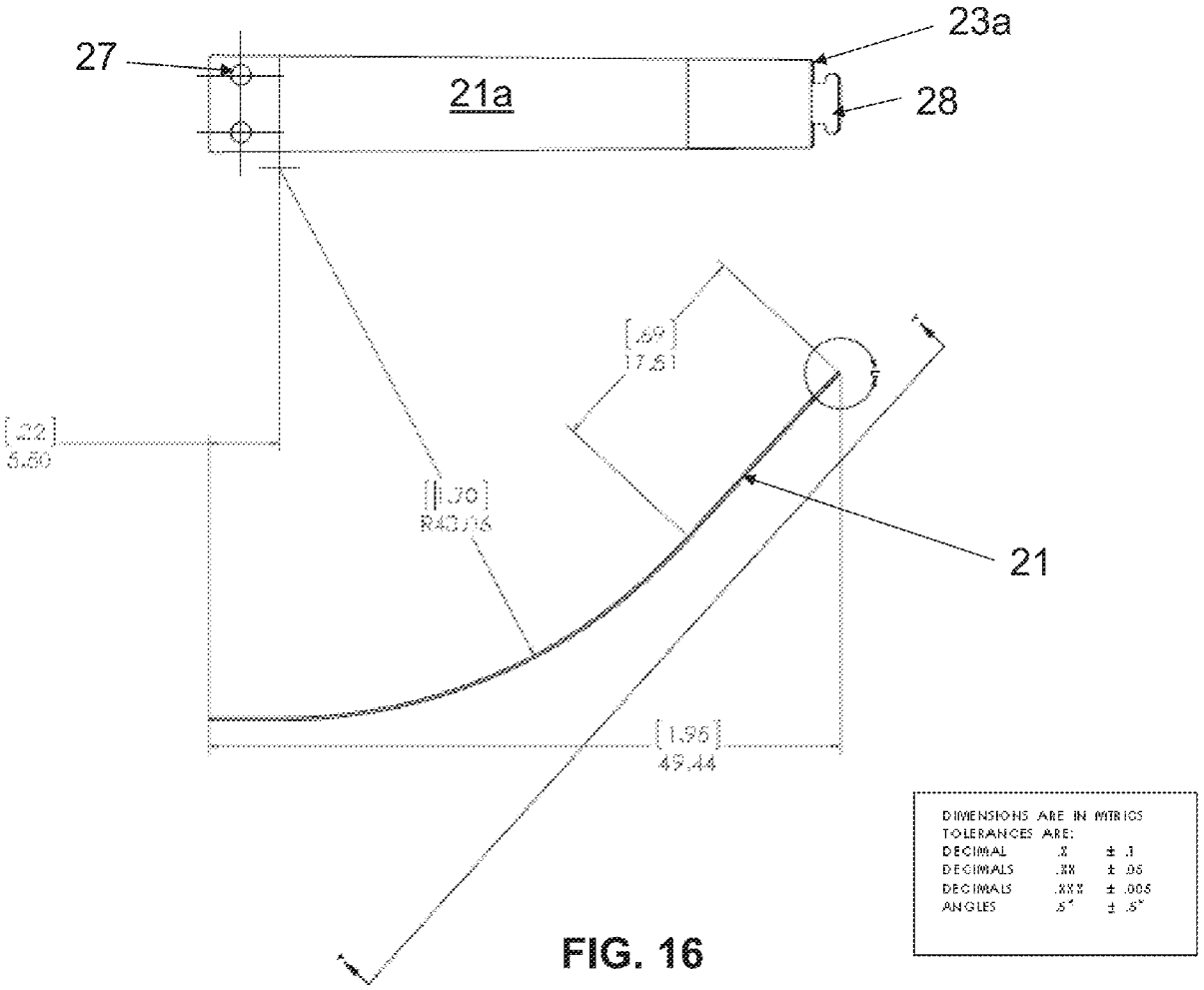
FIG. 16 depicts a male portion of a resilient member in top and side perspective.
Figure 17:
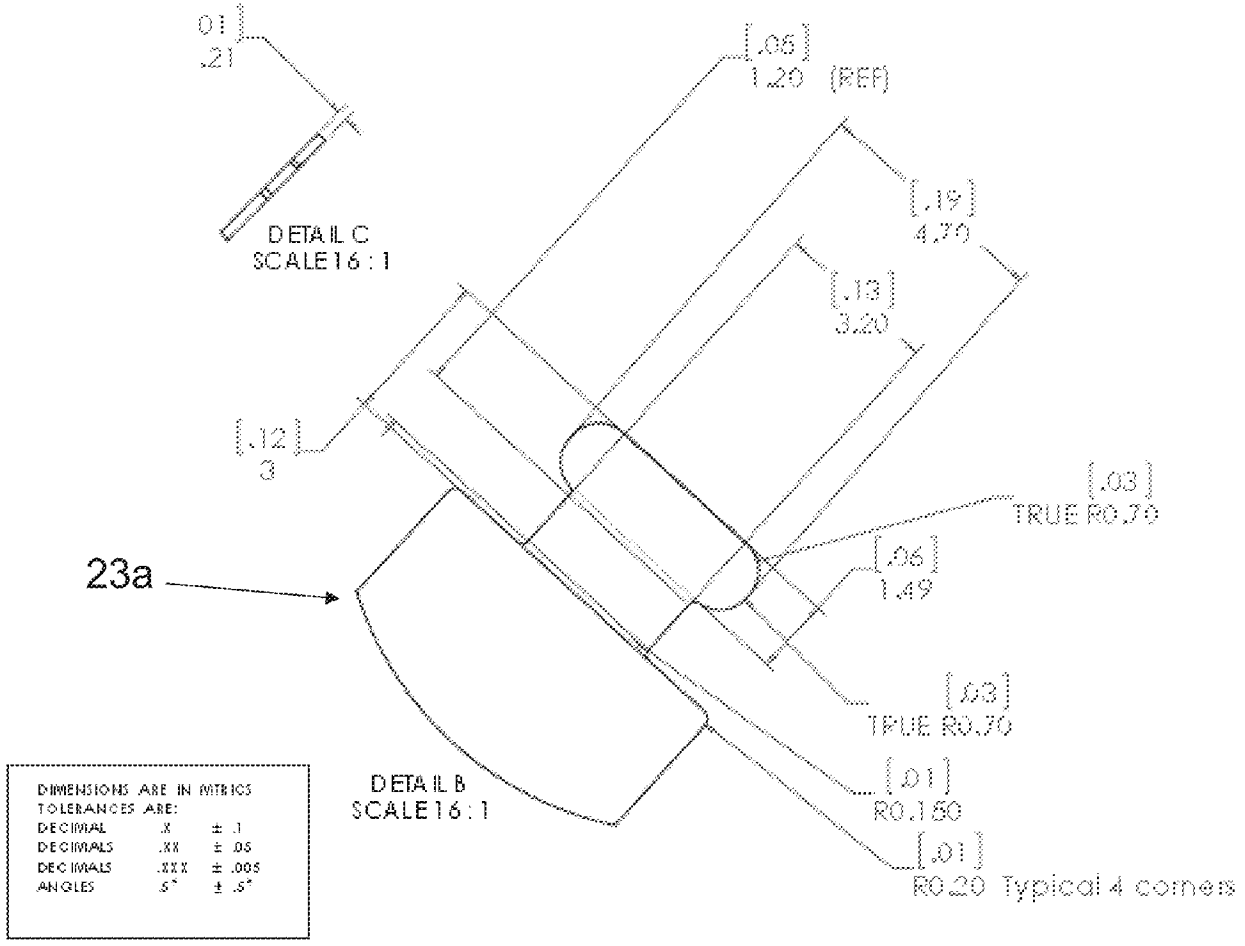
FIG. 17 details the male end portion of a resilient member.
Figure 18:
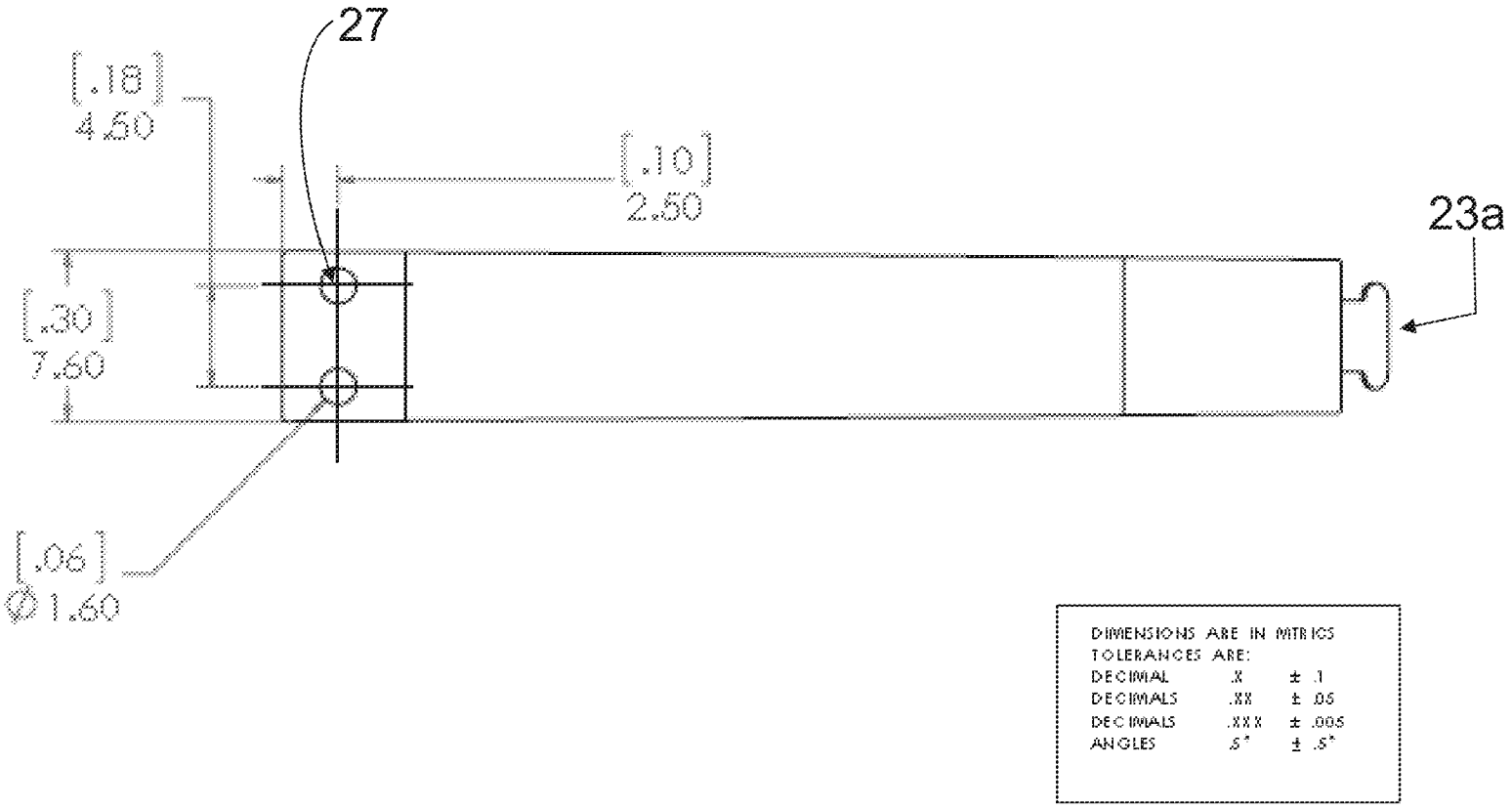
FIG. 18 details the male portion of a resilient member.
Figure 19:
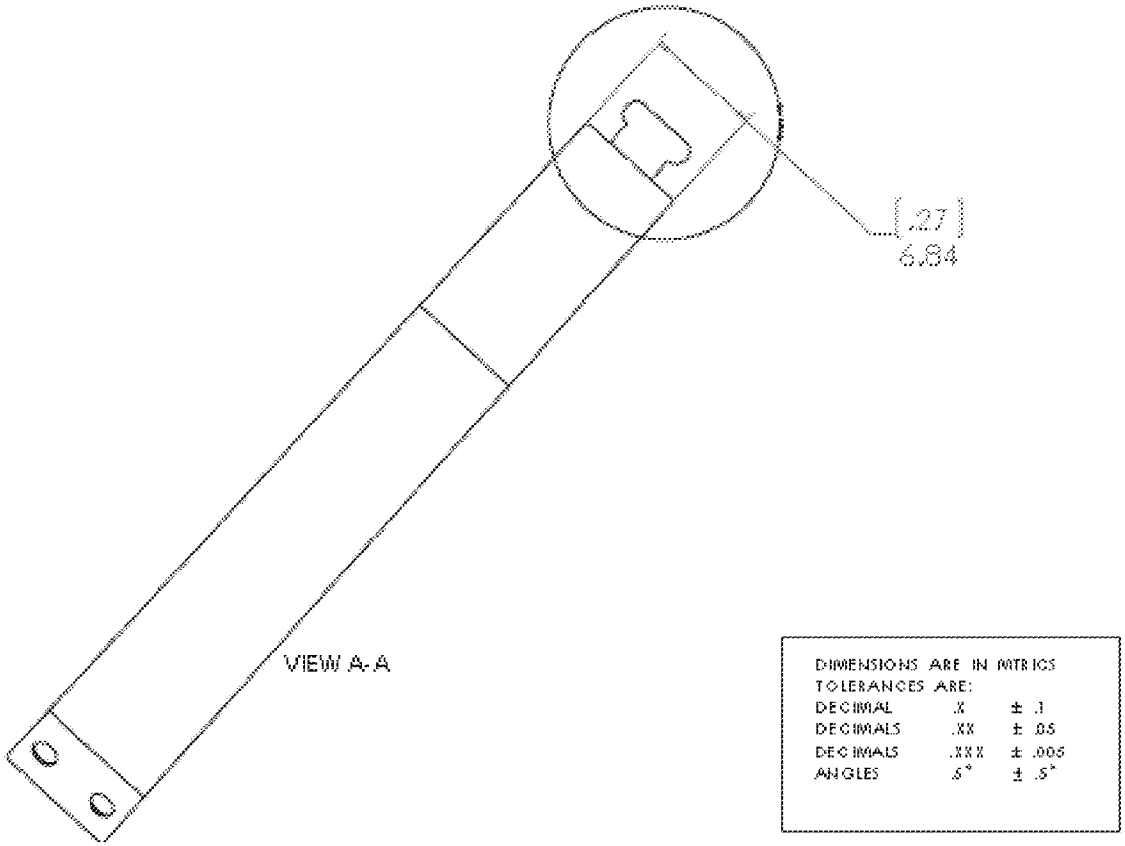
FIG. 19 also details the male portion of a resilient member.
Figure 20:
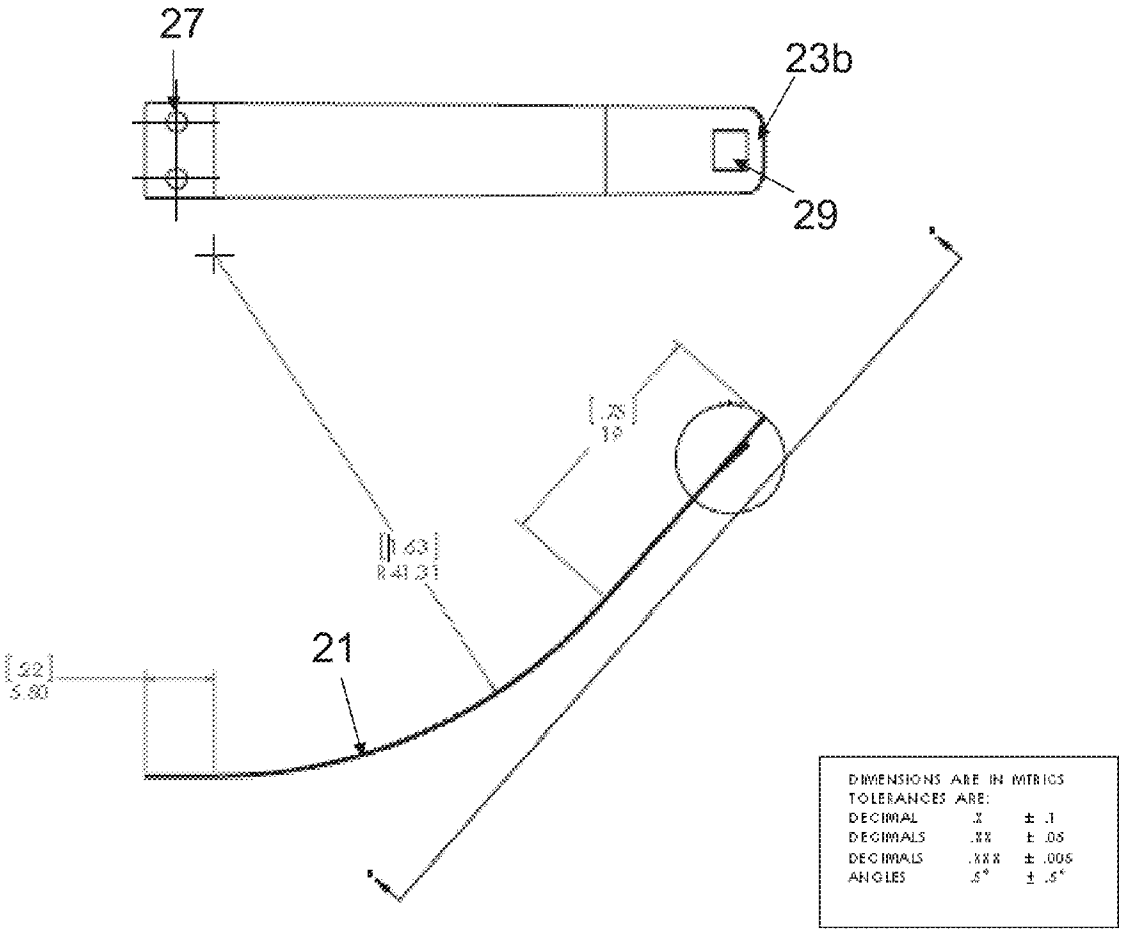
FIG. 20 depicts a female portion of a resilient member in top and side perspective.
Figure 21:
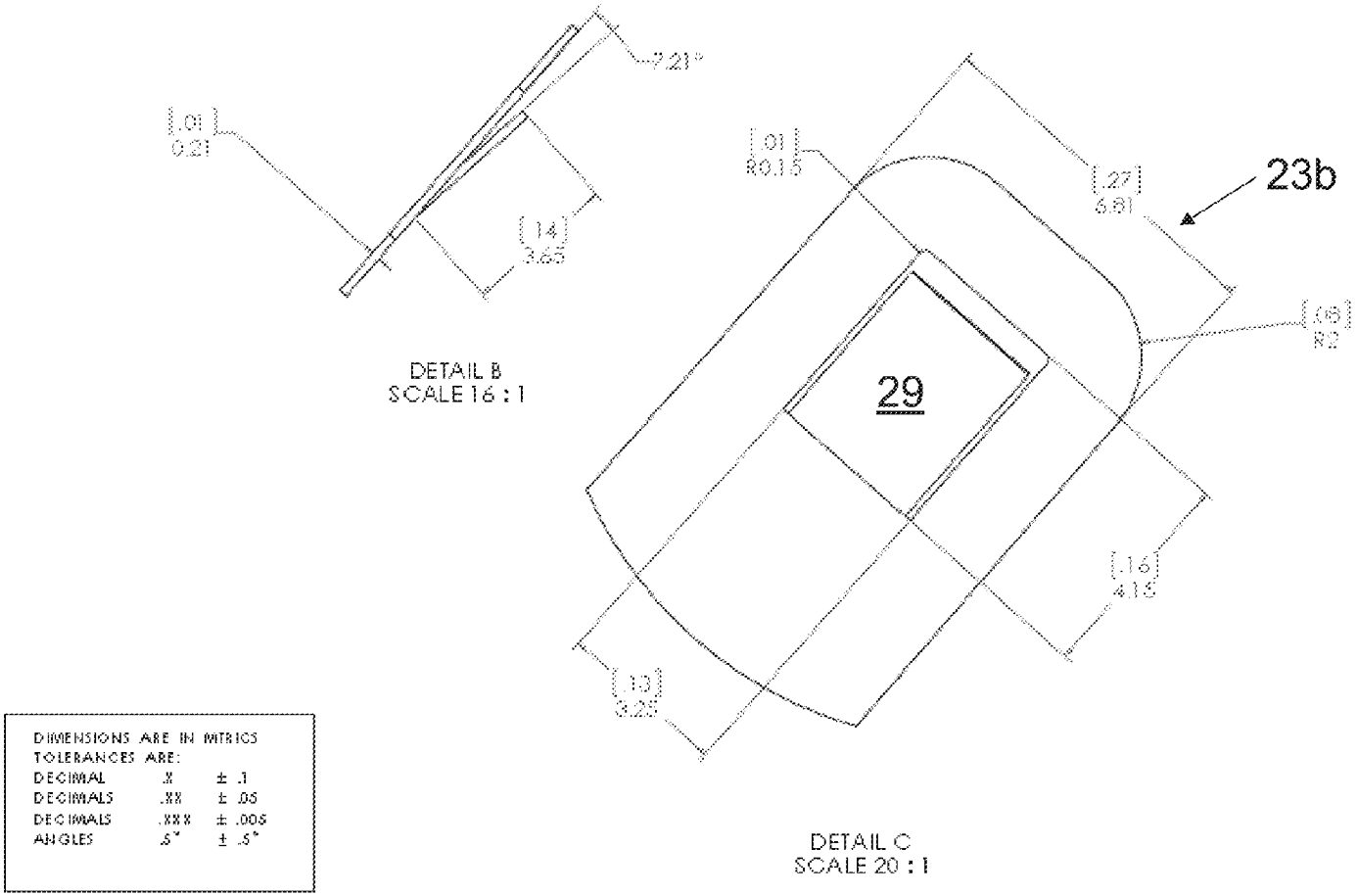
FIG. 21 details the female end portion of a resilient member.
Figure 22:
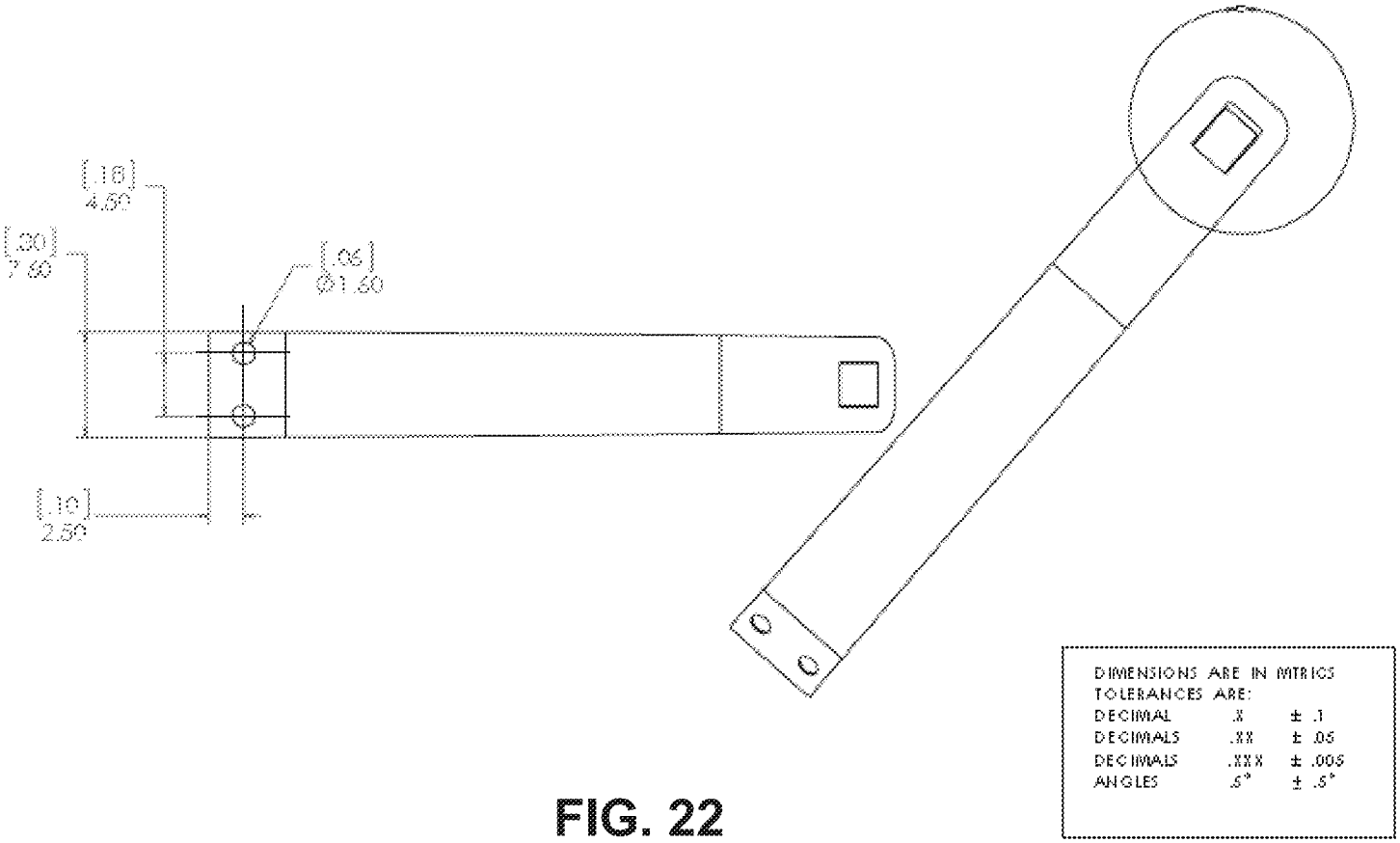
FIG. 22 details the female portion of a resilient member.
Figure 23:
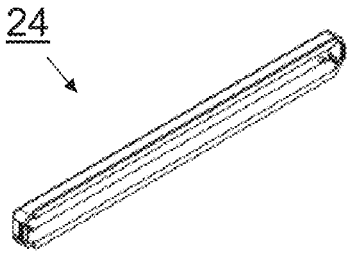
FIG. 23 is a perspective view of a housing without a resilient member.
Figure 24:
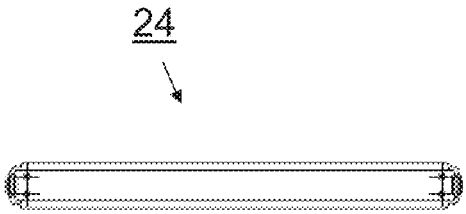
FIG. 24 is a top view of a housing without a resilient member.
Figure 25:
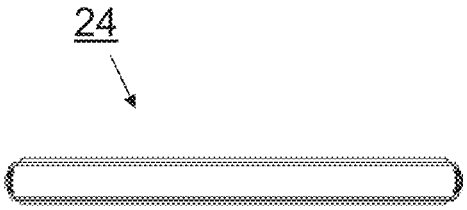
FIG. 25 is a bottom view of a housing.
Figure 26:
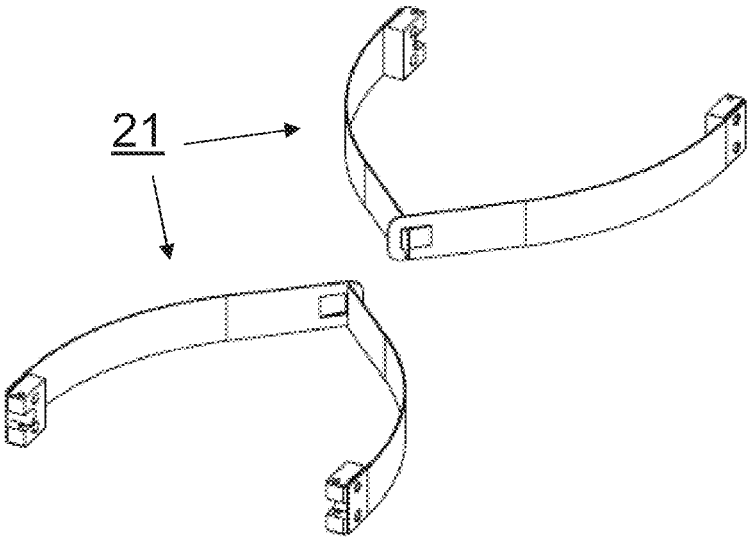
FIG. 26 is a perspective view of set of resilient members without a housing.
Figure 27:
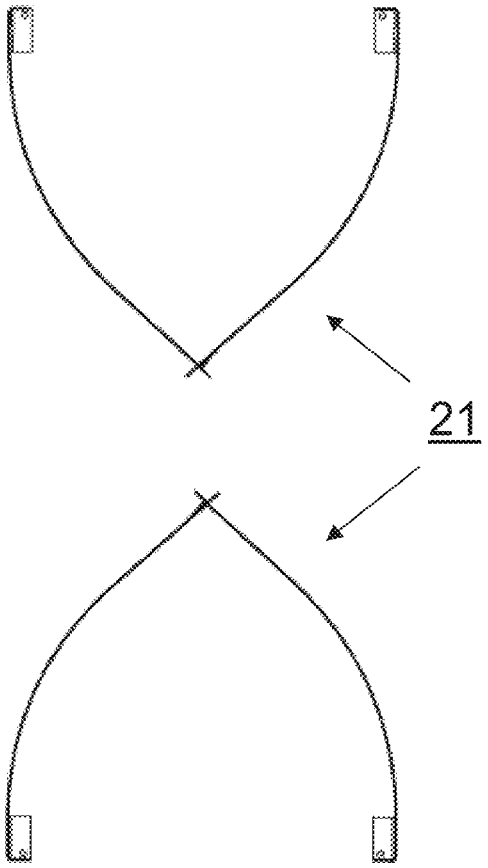
FIG. 27 is a side of set of resilient members without a housing.
Figure 28:
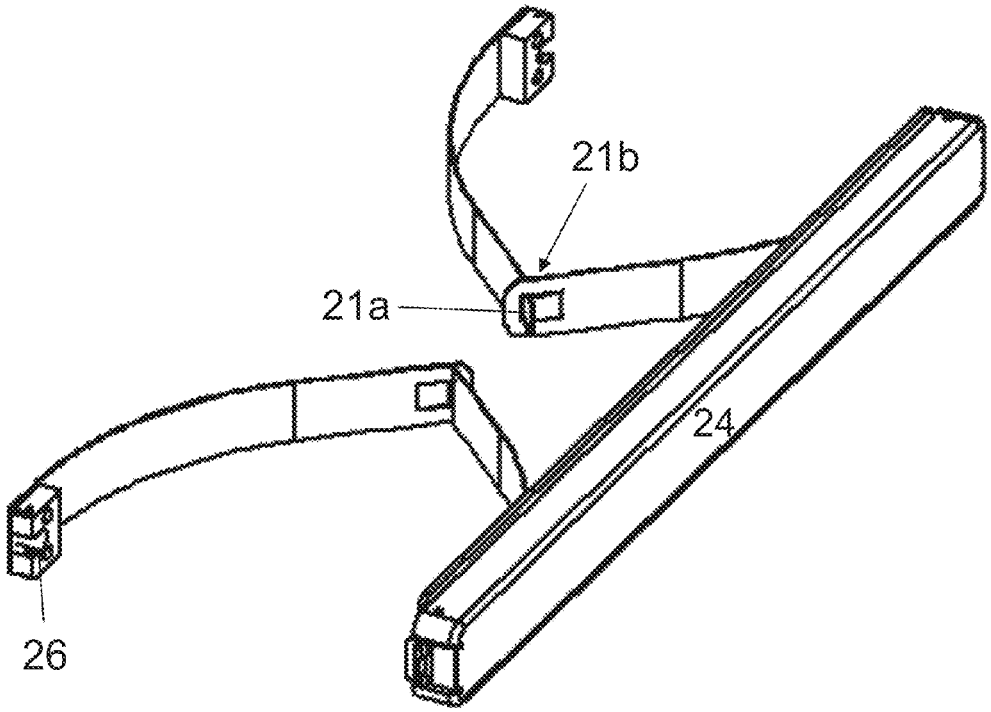
FIG. 28 is a perspective view of set of resilient members in one side of a housing.

As shown in FIG. 15, resilient members 21 are constructed of one male portion 21*a* and one female portion 21*b* that are attached one to another at attachment means 23. More specifically, male portion 21*a* terminates in male attachment means 23*a* having protrusion 28 (FIGS. 16-19), while female portion 21*b* terminates in female attachment means 23*b* having cut-out tab 29 (FIGS. 20-22). As best shown in FIG. 21, cut-out tab 29 is preferably a tab created by 3 cut sides. As shown in FIG. 15, protrusion 28 projects through cut-out tab 29 at attachment means 23.

Resilient members bend inwardly when primary arms 12 are adducted. It is preferred that resilient members are constructed of metal, and preferably surgical grade spring stainless steel, although plastic is also within the scope of the invention. It is desirable that resilient member 21 exerts a force of 7-16 ounces per square inch.

Figure 29:
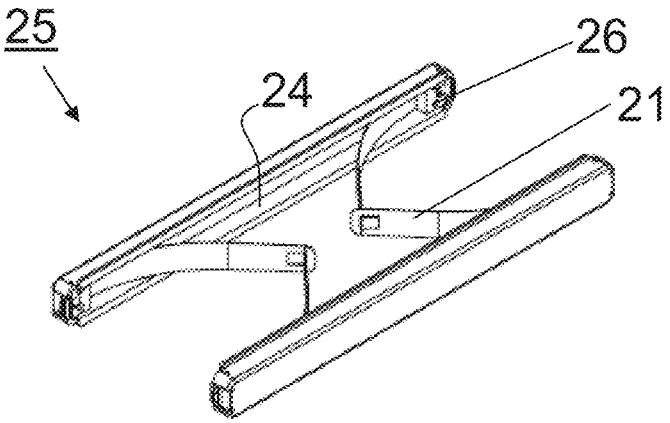
FIG. 29 is a perspective view of a cartridge.
Figure 30:
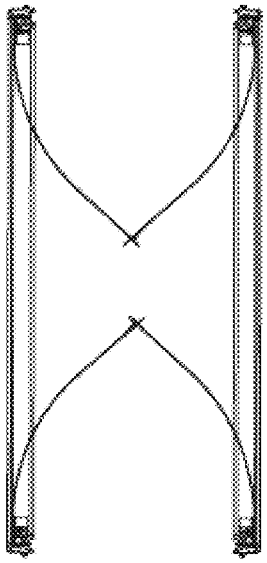
FIG. 30 is a side view of a cartridge.

In a preferred embodiment of FIG. 29, resilient member 21 is attached at interface 26 to inner region of housing 24, thereby forming cartridge 25. Two cartridges 25 are inserted into longitudinal recesses (not shown) of primary arms 12 for easily changing resilient members.

Figure 5:
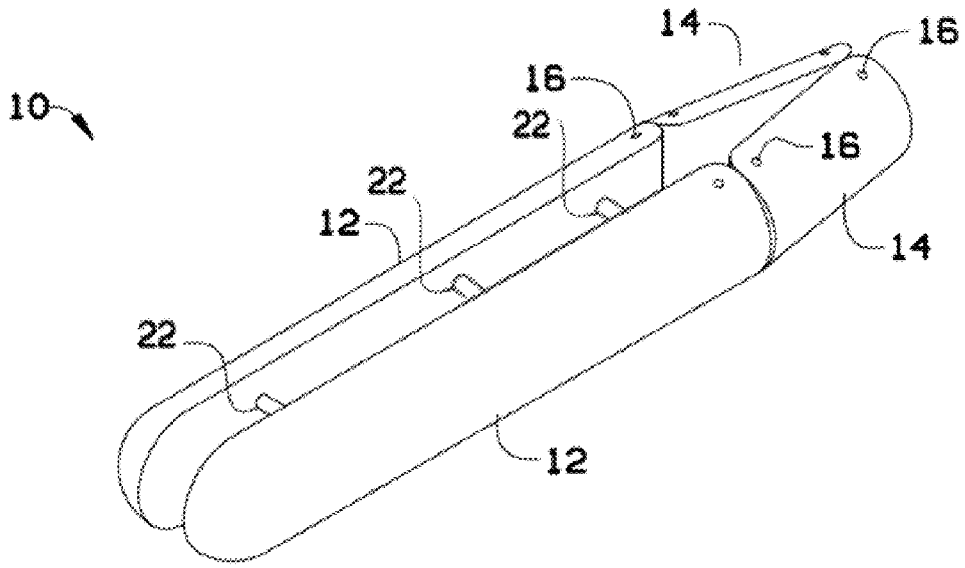
FIG. 5 is a perspective view of an embodiment in an expanded position.
Figure 10:
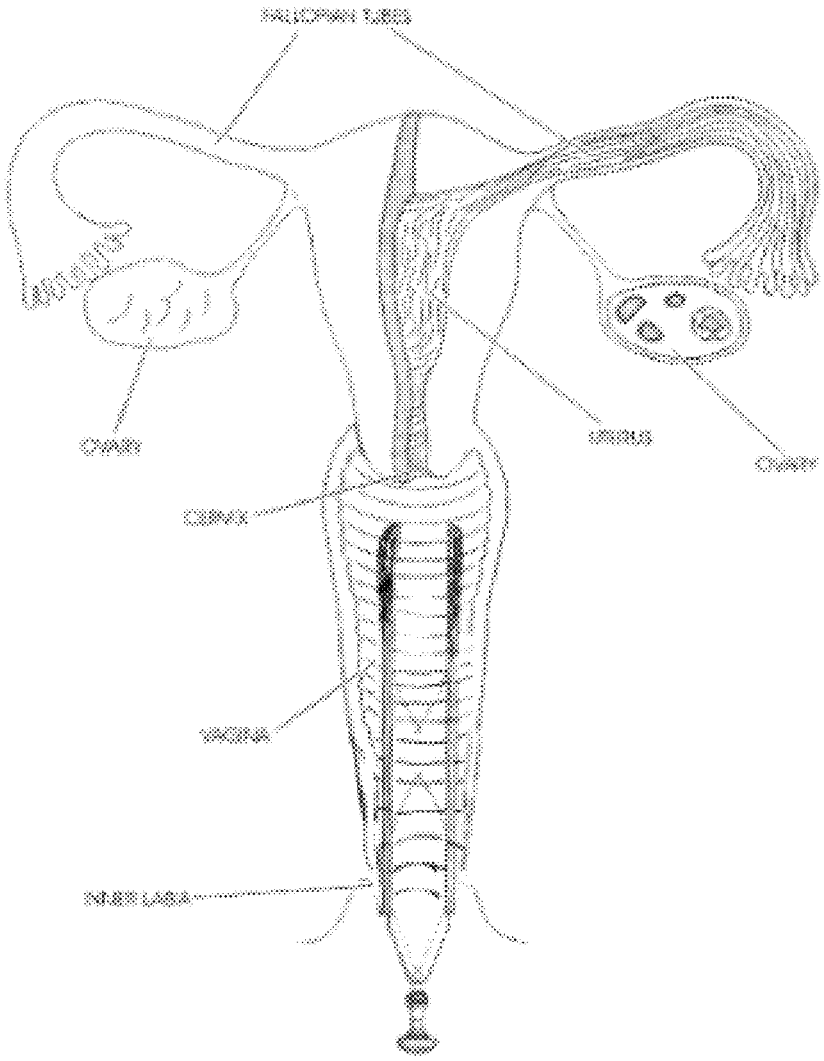
FIG. 10 is a view of a pelvic cavity depicting placement of the device inside a vagina.

In use, the device is longitudinally compressed and inserted, rounded head first, into the vagina. The proper position is depicted in FIG. 10. Upon releasing the device within the vagina, the device goes from compressed (FIG. 1) to expanded (FIG. 5) due to the outward force of the resilient members. The woman then performs contractions, thereby bringing arms 12 together to the compressed position, along the longitudinal axis, possibly in parallel, and subsequently releasing the forces so device returns to expanded position. The contraction can be held for a variety of durations. These exercises are preferably performed in a progressive strengthening regimen that includes both static and dynamic movements thereby allowing for greater carryover into functional activities.

The device can be used to overcome vaginal gapping, which is the degree to which the woman has difficulty in achieving vaginal closure, and to provide stability to the pelvis. Vaginal gapping is a factor that increases the likelihood of prolapsing, incontinence, lower back pain, and decreased to nonexistent orgasmic potential. In one embodiment of the invention a woman may use the device in a method that lessens vaginal gapping. In this method, the proper level, which corresponds with arm diameter, is selected, based on the size of the user's vaginal orifice. Typically this would be a level 4 or 3. The user initiates therapy by performing specific exercises (specific repetitions of contract, hold, release for specific time increments) using various resistance, over a specific period, typically six weeks to six months. After the specified time the user is evaluated, or self-evaluates, for improvement in the desired area. Such evaluation may be assessment of back pain and mobility, support of the viscera, enhancement of orgasm, sensations during vaginal penetration, and so forth. After establishing successful completion of the current level, the woman then substitutes the next lower level. Using the next lower level she performs the specific exercises over a specific period, then reassesses for suitability of progressing to the next level. The goal is to reach level 1 over a period of time. In this manner, vaginal gapping decreases.

Another method, basically the reverse, may be employed with women who suffer from dyspareunia, or painful intercourse. In this method, the woman would initiate the program using device 10 at the appropriate level, probably 1 or 2, based on the size of her vaginal orifice. After performing the specified regimen, the user is evaluated or self-evaluates for improvement. If acceptable improvement is achieved, she progresses to the next higher level. The goal is to reach level 4 over a period of time. In this manner the vagina is trained to comfortably accept a penis during intercourse.

Figure 4:
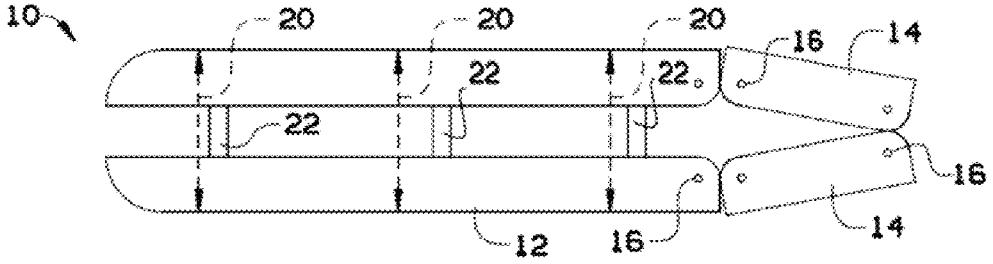
FIG. 4 is a top view of an embodiment in an expanded position.
Figure 7:
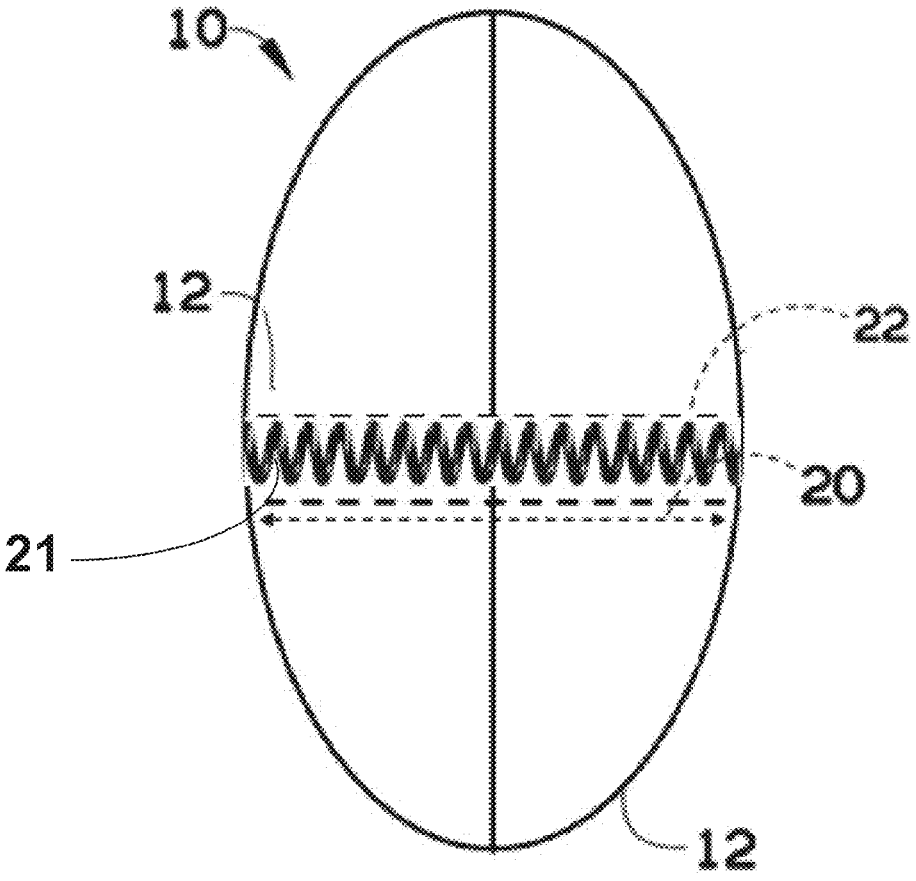
FIG. 7 is an end view of an embodiment.
Figure 8:
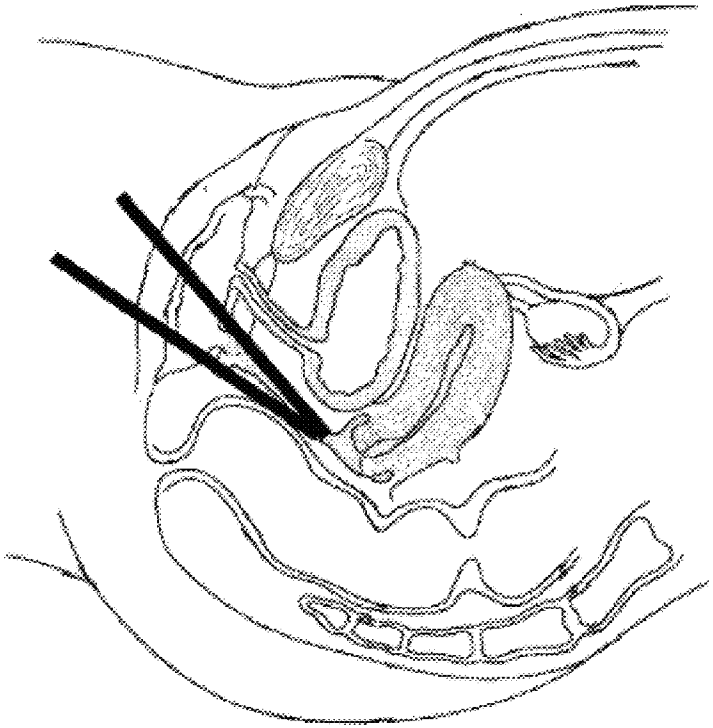
FIG. 8 depicts a known device inserted inside a vagina.
Figure 9:
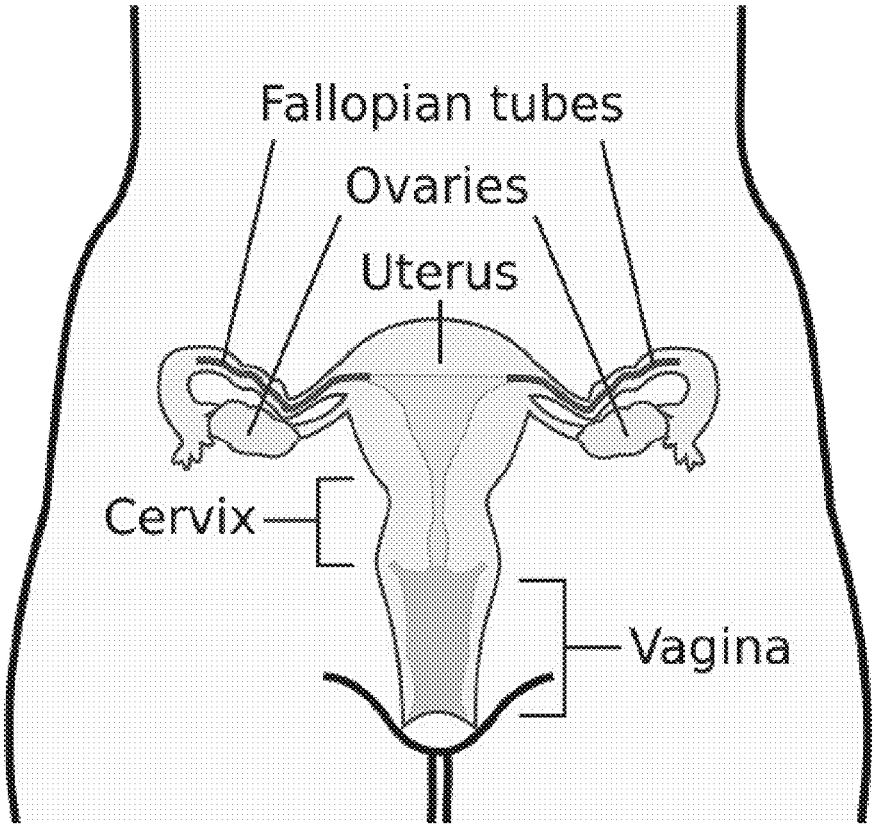
FIG. 9 is a view of a female human reproductive tract and ovaries.

The pelvic floor musculature is divided into three unique layers based upon their depth within the pelvic cavity. These three layers correspond with three distinct resistance axes 20 along the length of the device. This is shown in FIG. 4. The actual resistance is preferably provided by resilient members 21, within guide rods 22, as shown in FIG. 7. The resilience of the resilient members can vary, and is preferably interchangeable, in accordance with the woman's needs and limitations. Guide rods 22 (including resilient members) are preferably 1.0 to 1.5 cm apart from each other, and can offer symmetrical resistance or graded resistance, depending on the needs of the woman. In addition, the structure of device 10 lends itself to calibrated resistance functionality whereby a user can adjust resistance as desired.

In one method, device 10 is outfitted with the appropriate resistance (via resilient members within guide rods 22), and the user performs a series of muscular contractions. By way of example, she may be instructed to increase endurance by contracting and holding for 10 seconds and repeating 10-20 times. She may be instructed to train fast twitch muscles with single second holds which are repeated 20-100 times/session.

An example of a method to overcome vaginal gapping would be to for a woman to start at a circumference that allows for full contact of the device throughout the vagina and still provides a means of closure. For a specified duration the user performs a set number of contractions. An example of a regimen is 30-100 contractions of one second apiece, ten times for ten seconds, at least once a day. As discussed above, arm diameter is decreased over time.

A user that can't accept penetration during intimate activities would begin with the smallest overall circumference required so that there is no pain upon insertion. By way of example, the regimen would start at level 1, and the user would perform a set number of contractions, commonly ten seconds, ten times and 30-100 contractions of one second apiece. As she progresses, and penetration is tolerated the device can be adapted to allow a greater circumference. Levels will be increased until penetration during intercourse is comfortable.

An example of a method to heighten orgasm would be for a woman to isolate each specific layer of musculature by contracting/holding/releasing the device, most preferably in a rhythmical fashion. This rhythmic contraction is to initiate at the outer most layer of muscles, and continues to the middle and finally at the deepest, or third layer. A simple count of "one, two, three—relax, one, two, three—relax" will allow for a progressive coordination of these muscles. With practice, the woman can initiate a wave like contraction that during intimacy, and intimate contact, will facilitate an enhanced orgasm which is often self-perpetuating. This orgasm may enhance the woman's ability to conceive; research pending.

Generally a regimen would include 10 repetitions of maintaining a 10 second contraction, 100 repetitions of one second contractions, or somewhere between the two. The specific resistance employed would depend on the woman's strength.

It should be understood, of course, that the foregoing relates to exemplary embodiments of the invention and that modifications may be made without departing from the spirit and scope of the invention as set forth in the following claims. By way of example, resilient members can be springs or other resistance providing materials such as gaskets. Also, it is possible to rotate the device for vertical closure exercises. It should also be understood that ranges of values set forth herein inherently include those values, as well as all increments between. Also, "approximately" shall refer to +/−10%.

What is claimed is:

1. A device for improving pelvic health including:

a. Two semi-round primary arms aligned in parallel when in an adducted position;

b. A plurality of resilient members spanning said semi-round primary arms, said plurality of resilient members each distorting inwardly one towards another when primary arms are in said adducted position; and c. Two semi-round secondary arms connected to said two semi-round primary arms at a hinged joint.

2. The device of claim 1 wherein said two semi-round primary arms are ovoidal when said primary arms in said adducted position.

3. The device of claim 1 wherein said resilient members include two bendable members connected at an attachment means.

4. The device of claim 3 wherein said attachment means includes one of said bendable members interlocking with another of said bendable members.

5. A device for strengthening pelvic floor musculature including:

a. A first semi-ovoidal primary arm having a proximal end and a distal end, said proximal end hingedly connected to a first semi-ovoidal secondary arm;

b. A second semi-ovoidal primary arm having a proximal end and a distal end, said proximal end hingedly connected to a second semi-ovoidal secondary arms; and c. A handle hingedly connected to said first semi-ovoidal secondary arm and said second semi-ovoidal secondary arm, wherein said first and second primary arms are in parallel when in an adducted position, a plurality of resilient members spanning said semi-ovoidal primary arms.

6. The device of claim 5 wherein said first and second semi-ovoidal secondary arms each have a proximal end and a distal end, said respective primary semi-ovoidal arms connected to the distal ends of said corresponding semi-ovoidal secondary arms.

7. The device of claim 5 wherein said first and second semi-ovoidal primary arms adduct to form a substantially hollow ovoidal primary structure.

8. The device of claim 7 further comprising exactly one pair of resilient members between said first semi-ovoidal primary arm and said second semi-ovoidal primary arm.

9. The device of claim 8 wherein said resilient members are enclosed within said ovoidal primary structure upon adduction of said primary and said secondary semi-ovoidal primary arms.

10. A method for strengthening pelvic floor musculature including the steps of:

a. Inserting a device for strengthening pelvic floor musculature into a vagina, said device including two semi-round primary arms aligned in parallel when in an adducted position; a plurality of resilient members spanning said semi-round arms; two semi-round secondary arms hingedly connected to said two semi-round primary arms; and a handle hingedly connected to said two semi-round secondary arms;

b. Compressing said resilient members, thereby adducting said primary arms; and c. Allowing said resilient members to expand, thereby abducting said primary arms.

11. The method of claim 10 wherein said step of compressing said resilient members includes the step of adducting said semi-round primary arms substantially in parallel.

12. The method of claim 10 further including the initial step of selecting a device having semi-round primary arms of a desired diameter.

13. The method of claim 10 further including the initial step of attaching said semi-round primary arms of a desired diameter to said semi-round secondary arms.

14. The method of claim 10 further including the initial step of substantially enclosing said semi-round primary arms in a sleeve.

15. The method of claim 14 further including the initial step of selecting a sleeve having a desired diameter.

16. The method of claim 10 wherein said step of compressing said resilient members includes the step of compressing resilient members housed in cartridges, wherein said cartridges are oriented longitudinally within said semi-round primary arms.

17. The method of claim 16 further including the step of removing said cartridges and inserting different cartridges.

* * * * *